United States Patent [19]

Wright

[11] Patent Number: 4,584,098

[45] Date of Patent: Apr. 22, 1986

[54] ORE CONCENTRATOR

[76] Inventor: Winston Wright, 2660 Fair Cir., Reno, Nev. 89503

[21] Appl. No.: 535,427

[22] Filed: Sep. 26, 1983

[51] Int. Cl.[4] ..... B03B 5/50

[52] U.S. Cl. ..... 209/430; 209/493; 209/508

[58] Field of Search ..... 209/365 A, 394, 404, 209/413, 428, 429, 430, 431, 432, 433, 493, 492, 506, 451, 452, 470, 481, 507, 615, 616, 689, 690, 695, 508

[56] References Cited

U.S. PATENT DOCUMENTS

| | | | |
|---|---|---|---|
| 58,931 | 10/1866 | Woodside | 209/430 |
| 251,913 | 1/1882 | Meech | 209/430 |
| 416,704 | 12/1889 | Holland | 209/430 |
| 714,257 | 11/1902 | Sutton et al. | 209/470 |
| 776,662 | 12/1904 | Horn | 209/506 |
| 781,787 | 2/1905 | Prouty | 209/430 |
| 861,787 | 7/1907 | Wiswell | 209/433 |
| 884,636 | 4/1908 | Buckingham | 209/433 |
| 890,497 | 6/1908 | Clark | 209/506 |
| 943,789 | 12/1909 | Roberts | 209/507 |
| 1,423,130 | 7/1922 | McCoy | 209/433 |
| 2,989,184 | 9/1958 | Gobatti | 209/507 |
| 3,976,567 | 8/1976 | MacElvain et al. | 209/506 |

FOREIGN PATENT DOCUMENTS

| | | | |
|---|---|---|---|
| 551193 | 11/1956 | Italy | 209/615 |

*Primary Examiner*—John Adee
*Assistant Examiner*—Wanda L. Millard
*Attorney, Agent, or Firm*—Bielen & Peterson

[57] ABSTRACT

A continuous concentrator for high volume specific gravity separation of materials, particularly constituent materials of indigenous ores, in a counter-current process, the concentrator includes a continuous loop conveyor constructed with a conveyor bed on which are mounted periodic transverse riffles, and raised sidewalls for containing ore materials deposited on the bed from an ore feed; and, a bar sweeper constructed with a pair of continuous loop, link drives interconnected by transverse sweeper bars adjustably positioned over the conveyor bed, the bar sweeper being operated with the sweeper bars moving proximate the top of the conveyor riffles in an opposite direction from the movement of the conveyor, the rate of movement of the bar sweeper and conveyor being independently controlled for processing ores of different composition or consistency, wherein heavier metals and minerals are conveyed in one direction on the conveyor bed to one end of the conveyor for discharge and collection, and the lighter metals and minerals are swepted in the opposite direction by the bar sweeper to the other end of the conveyor for discharge and collection.

15 Claims, 5 Drawing Figures

FIG-2
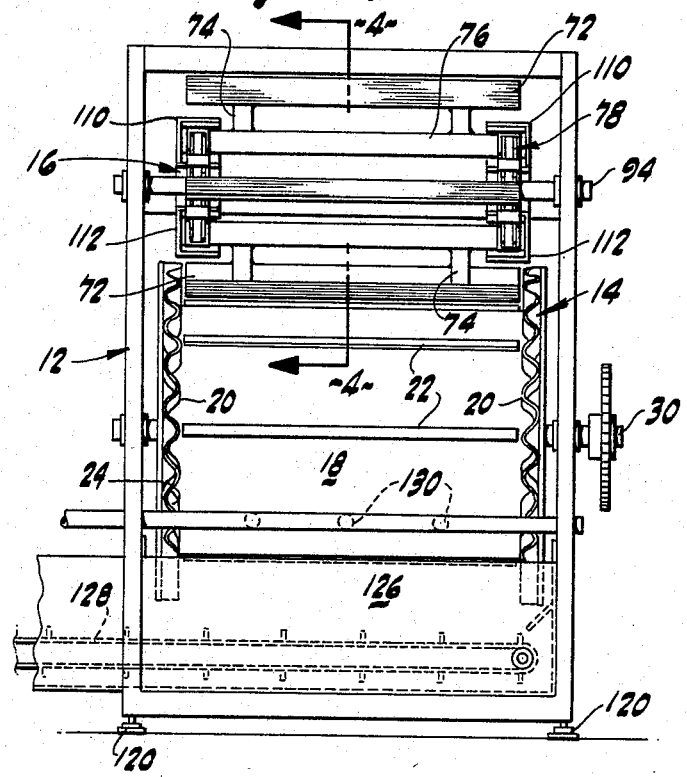
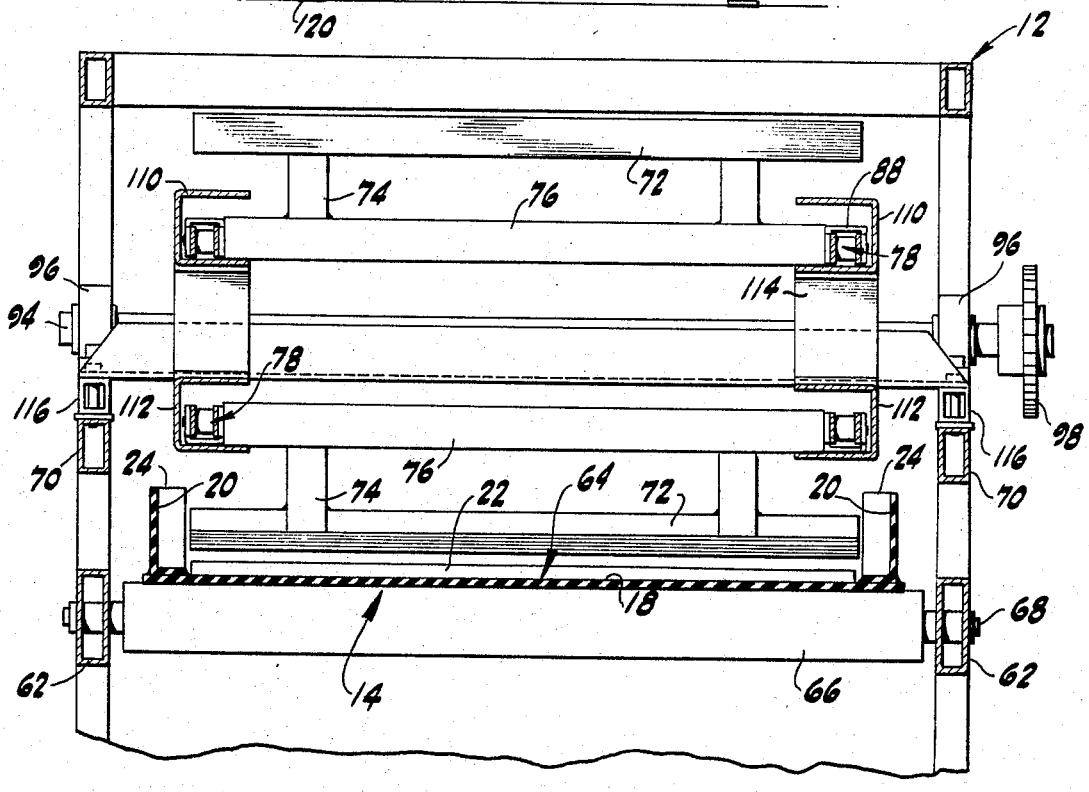
FIG-3

ORE CONCENTRATOR

BACKGROUND OF THE INVENTION

This invention related to apparatus and a mechanical process for specific gravity separation of ore materials to separate an ore concentrate of primary materials from secondary materials in a continuous, high volume process. In particular, this invention utilizes a countercurrent mechanical separation of composition materials of an indigenous ore, conveying heavier constituent materials in a first direction on a moving bed, and sweeping ligher constituent materials in a second opposite direction.

In most ore refining operations it is desirable to separate constituent materials according to specific gravity. Depending on the composition of the ore, either the heavier material or the lighter material may be sought as the prime material for recovery. For example, in gold processing a concentrate of a heavier gold magnetite pyrite, etc., may be sought for further refining, with the lighter residue having little or no value. However, in coal processing, the lighter coal is sought with the heavier ash and pyrite residue having little or no value.

While some devices, such as cyclones have in the past provided one means of separation, the water requirements and equipment wear are comparatively high. Additionally, cycloning requires that the feedstock be of relatively uniform size, often requiring extensive crushing and/or screening. For many materials such as placer gold, this is an unnecessary expense contributing to overall high operating costs for recovery of usually small particles of liberated metal.

The apparatus of this invention is designed to separate constituent materials of various consistency, from placer gold, mixed with residual material of size up to three or four inch diameter, without prior classifying, to uniform small particle indigenous or crushed material, such as powdered coal or fine mineral or metal bearing sands.

Further, because of the mechanical agitation imparted by the components during processing, minimal ore preparation is required to breakup clays and other physically bound materials, thereby elimating in most instances, the necessity of trommels or other auxilliary washing or classifying equipment.

The subject apparatus mixes, rakes and classifies, and separates the heavier and lighter materials in a single continuous operation, and is designed for cost efficient high volume processing.

SUMMARY OF THE INVENTION

A continuous concentrator for separating constituent materials of a mix into heavier and lighter concentrates. The concentrator of this invention is particularly designed for ore slurries, but may in some instances be suitable for separating dry substances. The concentrator utilizes a countercurrent process to mix, rake, classify and, by specific gravity, separate the constituent materials of the ore in a continuous process. A primary conveyer, having a continuous flat bed with high vertical sides has a plurality of spaced, linear riffles transversely disposed on the bed to entrap heavier materials. The conveyer is constructed with a rubber-type belt with rubber-type sides for complete water and slurry proof containment and high impact wear for handling coarse ores.

The primary conveyer is transported around two large spaced drums. The upper segment of the conveyer between the two drums is supported by a series of rollers contacting the underside of the bed to provide a flat expansive surface for mechanically processing ore deposited thereon.

A secondary conveyer or sweeper is independently operated and arranged over the primary conveyer and constructed with a series of rakes or sweeper bars disposed proximate the tops of the riffles. The sweeper bars are continuously conveyed if a direction opposite the direction of the upper segment of the bed, and function to mix, rake, and classify the ore slurry deposited on the bed.

The churning action imparted by the sweeper bars and oppositely moving riffles cause heavier material to settle close to the bed with lighter material being continuously swept across the tops of the riffles to a first discharge over one end of the primary conveyer. Where the ore material has not been previously sized to a uniform consistency, the sweeper bars classify the ore material forcing the over-sized material, such as rock up to 3 or 4 inches in size, to the first discharge end of the primary conveyer. In this manner for many ores, trommels or screens are unnecessary, thereby resulting in a substantial savings in process costs.

The high sides of the primary conveyer allow the sweeper bars to be placed down between the sides of the conveyer, close to the bed to permit a raking and churning of initially deposited material allowing spill over the bars without the material escaping from the conveyer.

As the primary conveyer moves the settled heavier material to a second discharge at the end of the conveyer toward which the belt is moving, the sweeper bars act as a skimmer, sweeping the top layer of material without spill over before the heavier material protected by the riffles is finally discharged.

By select control of the speed of operation of the primary conveyer and the rake or sweeper; by adjustment of the height and inclination of the sweeper over the bed of the conveyer; and, by variance of the height and configuration of the riffles, a wide variety of materials can be processed and effectively separated into two discharge products. In some instances it may be desirable to use two concentrators in series differently adjusted to achieve a further concentrated end product.

The high wall conveyer design and continuous operation allows a high volume of material to be processed. A ten foot long, six foot high concentrator is capable of processing a thousand cubic yards of material per day. With appropriate care, the size of the concentrator can be enlarged to increase the quantity of material processed.

The concentrator is designed to use a relatively thick water slurry to minimize the consumption of water. By proper reclamation of water by filtering or settling ponds, the concentrator is suitable for efficient operation in arid regions.

BRIEF DESCRIPTION OF THE DRAWINGS

FIG. 2 is an end elevational view of the concentrator of FIG. 1.

FIG. 3 is an enlarged fragmentary cross-sectional view taken on the lines 3—3 in FIG. 2.

DETAILED DESCRIPTION OF THE PREFERRED EMBODIMENTS

Figure 1:
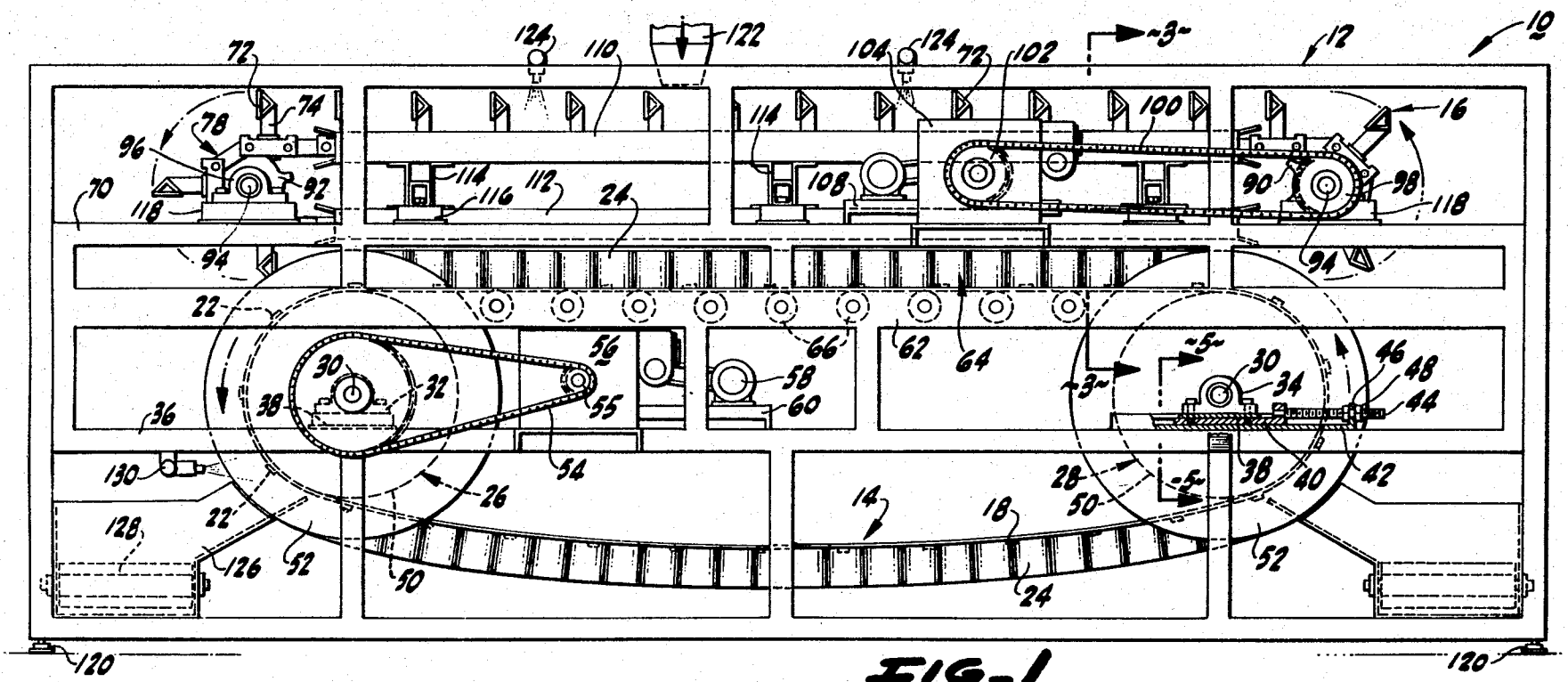
FIG. 1 is a side elevational view of the concentrator.

The ore concentrator of this invention is designated generally by the references numeral 10 as shown in the side elevational view of FIG. 1. The concentrator is constructed utilizing box-beam frame 12 on which are mounted the cooperating components of the apparatus. The frame 12 provides a modular structural form for the apparatus to facilitate transport and rapid setup and operation of the concentrator.

The modular construction is suitable for mounting the concentrator on a truck bed for operation as a mobile unit for relatively inaccessible terrains.

The principal components of the concentrator are a continuous conveyer 14 operating in a first direction and a continuous rake or bar sweeper 16 operating in a second direction opposite the direction of the conveyer 14. The conveyer is specially designed with a flat wide bed 18 and high sidewalls 20 as shown in FIGS. 2 and 3, for containing substantial quantities of material. Spaced riffles 22 are transversely secured to the otherwise flat surface of the bed 18. The riffles are rectangular in cross section, but may be of different configuration, size and spacing depending on the characteristics of the processed material which is customerily an ore slurry.

The high conveyer sidewalls 20 are fabricated from a rippled web 24, perpendicularly mounted to the edges of the bed 18. The accordian construction of the side web 24 enables the sidewalls 20 be transported around large end drums 26 and 28, while maintaining their natural containing function.

Figure 4:
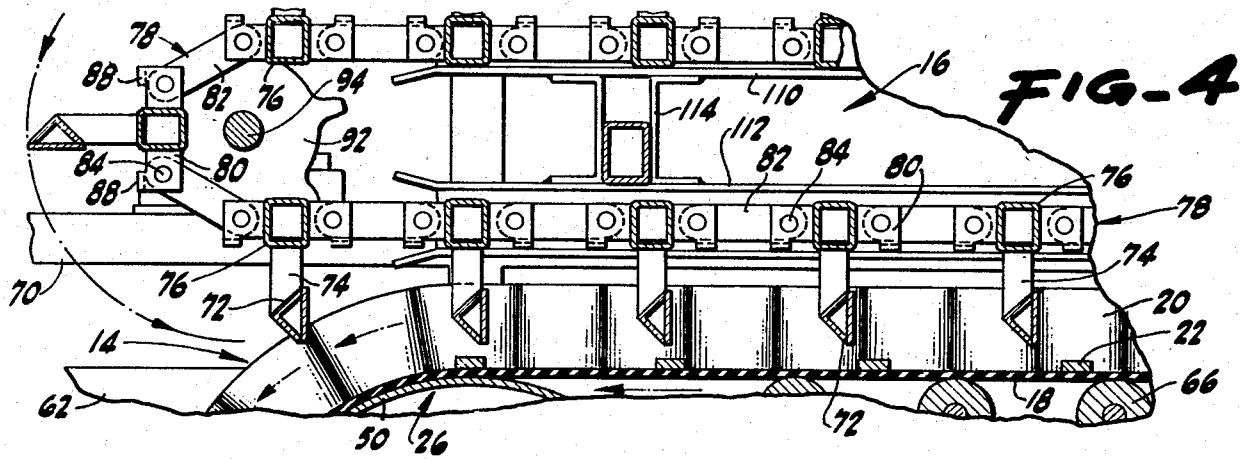
FIG. 4 is a partial cross-sectional view taken on the lines 4—4 of FIG. 1.

The large end drums, 26 and 28, each have a center shaft 30 mounted in pairs in journal bearings 32 and 34, which seat on a horizontal support rail 36 comprising an integral part of the frame 12. The journal bearing 32 on each side the drive drum 26 is bolted to the rail and is adjustable in vertical position by spacer shims 38 for purposes described hereafter. The journal bearing 34 on each side of the follower drum 28 is similarly vertically adjustable by shims 38 and is bolted to a side plate 40 which engages a slotted way 42 welded to the frame rail 36, as shown in FIG. 4. A turn screw 44 through an end plate 46 on the way 42 is connected to the slide plate and bearing allowing horizontal displacement of the bearing 34 on adjustment of nuts 48 arranged on each side of the end plate 46. Horizontal adjustment of the bearings 34 assures proper alignment and tension of the conveyer 14 as it is transported around the spaced drums.

Referring to the end view of FIG. 2 the illustrated drum 26 has a cylindrical center 50 for maintaining the integrity of the straight transverse riffles 22, and have enlarged disclike, end plates 52, to maintain the integrity of the rippled side webs 24 as they flex on transport around the slowly rotating drums. Preferably both the conveyer bed and side webs are fabricated from a rubber-like material for impact resistance and water retention.

The drums are reotated by a drive chain 53 which engages a large gear sprocket 54 on the end of the shaft 30 of the drive drum 26, and a smaller sprocket 55 projecting from a hydraulic reduction transmission 56 which is driven by an electric motor 58. The transmission 56 and motor 58 are mounted on a support plate 60 mounted between the horizontal support rail 36 and a horizontal roller mount rail 62 located above the support rail 36 for the drum bearings. The follower drum 28 is rotated by action of the continuous conveyer bed 18 which is carried in a continuous loop around the two spaced drums.

Figure 5:
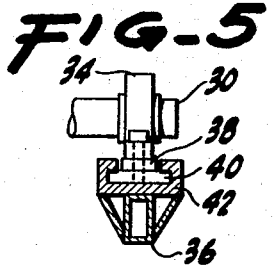
FIG. 5 is a cross-sectional view taken on the lines 5—5 in FIG. 1.

The upper segment 64 of the conveyer, on which is deposited material for specific gravity separation or concentration, is supported from sagging by a series of closely spaced rollers 66, (one shown in FIG. 5). The rollers 66 have their shaft ends connected by bolts 68 at the roller mount rail to uniformly space the series of rollers between the drums as is apparent from FIG. 1. While the rollers may be substituted by a slide plate over which the conveyer is transported, the low friction rollers provide a relatively flat conveyer bed, and impart a slight agitating movement to the bed that enhances material separations. In some instances, for example where a light weight material is deposited on the conveyer bed and friction factors are not high, a slide plate, optionally enhanced by a vibratory oscillator, may be substituted for the roller system shown.

The bar sweeper 16 is mounted above the conveyer on a third frame rail 70, and is positioned to dispose a continuous series of rakes or sweeper bars 72 across the conveyer bed 18. The sweeper bars 72 are structurally connected by post members 74 to cross bars 76. The cross bars 76 are connected at each end to alternate links in a continuous link chain 78, also shown in the enlarged view of FIG. 3.

The link chain 76 is constructed with outer and inner links, 80 and 82 pivotally interconnected by cross pins 84 which comprise the drive rollers 86. A spacer bar 88 fixed across opposed outer links maintains the spacing integrity of the link chain 76 and transfers forces generated by the rigidly connected cross bar 76 to both sides of each chain.

The two continuous link chains are carried over large sprockets 90 and 92 on parallel shafts 94 spaced at each end of the concentrator. The shafts 94 are supported in journal bearings 96 mounted on the support rail 70.

At one end, the sprocket shaft 94 has a chain sprocket 98 mounted on its distal end which engages a small drive chain 100. The drive chain 100 engages the output sprocket 102 of a reduction transmission 104 similar to the transmission for the conveyer drum. The transmission 104 is powered by an electrical motor 106. The transmission and motor are mounted on a support plate assembly 108.

In order to provide proper orientation of the sweeper bars 72 over the conveyer bed 18 and to prevent a possible interferring sag in the sweeper components on their return path, a pair of upper and lower guide channels 110 and 112 are provided. The guide channels are interconnected by brackets 114 and supported on the rail 70 by bolted spacer blocks 116. The bearings 96 are mounted on spacer plates 118, such that by adding shims or replacing the spacers with different sized spacers, the sweeper apparatus can be raised or lowered to position the sweeper bars at the top of the riffles or variably displaced therefrom.

The use of spacers or shims for mounting both the lower conveyer and the upper sweeper to the structural frame allows a substantial degree of flexibility in adjusting the concentrator for a particular material to be processed. In addition to the more apparent raising or lowering of the bar sweeper above the bed of the conveyer by the use of uniform spacers, the bar sweeper can be adjusted by progressively larger spacers from one end to the other to vary the clearance between the sweeper bars and the conveyer bed.

For example if the concentrator is operated to concentrate a placer gold from a variable sized residue, it is advantageous to position the sweeper such that the sweeper bars become progressively lower as the concentrate moves on the conveyer belt to its discharge end.

Also, if it is desired that water flow from a slurry deposited on the conveyer favor the concentrate discharge end, lowering the conveyer drum, adjacent the concentrate discharge and raising the distant drum will accomplish this bias.

Where a substantial incline to the conveyer bed is desired, adjustable screw jacks 120 are provided at each bottom corner of the frame 12 for raising or lowering a selected end of the frame or for adding a transverse cant to the concentrator.

Feed control is provided by the continuously available reduction transmissions for both the conveyer and sweeper. The conveyer speed is independent of the speed of the sweeper and either may range from inches per minute to feet per minute.

During operation, conventional auxillary components provide for feed and collection of separated constituent materials. For example, a discharge orifice 122 from a regulated hopper (not shown) may be centrally positioned over the concentrator to deposit an input material through the sweeper apparatus and onto the bed of the conveyer. Ordinarily the feed material is in a thick slurry. The sweeper bars are triangular in cross section inhibiting hangup of feed material on the sweeper structure. One or more downwardly directed spray nozzles 124 are incorporated on the top of the frame to wash the sweeper structure and supplement the slurry mix.

As the conveyer moves the bed containing the deposited material in a first direction, from right to left in FIG. 1, the bar sweeper moves the active bars in the opposite direction, from left to right. The counter direction action of the riffles and sweeper bars provides a substantial agitating and churning action to the slurry causing the heavier material to fall close to the conveyer bed and the larger material to rise. The lower heavier material is transported over the end drum, and deposited on an auxilliary discharge chute 126 for collection in a bin or as shown, for discharge on a belt 128 for collection.

To insure complete collection, a spray nozzle 130 is mounted on the frame to direct a liquid spray at the surface of the bed of the conveyer as it rounds the drum. Other spray nozzles may be appropriately positioned for cleaning or supplementing the slurry.

The upper lighter material is sweeped by the sweeper bars against the current of the conveyer to the opposite end where it is pushed over the end drum into a similar shute for collection in a bin or as shown deposited on a collection belt 132.

By appropriate adjusted positioning of the conveyer bed, the bar sweeper or the entire concentrator, and appropriate regulation of conveyer speed bar sweeper speed and material feed rate, a wide variety of materials can be separated and classified.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A concentrator for specific gravity separation of materials comprising:

(a) a continuous loop conveyor having a bed with transverse riffles and substantially vertical side walls, said bed having a substantially flat top segment on which feed material is deposited;

(b) a bar sweeper having a plurality of transverse bars with a sweep segment of the bar sweeper operably disposed over said flat top segment of said bed proximate the transverse riffles for substantially parallel movement with respect to said flat top segment of said bed: and (c) first drive means for mechanically operating said conveyor and moving said flat top segment of said bed and said transverse riffles in a first direction and second drive means for mechanically operating said bar sweeper and moving said sweep segment and bars in an interacting second direction opposite the direction of the flat top segment of said bed, wherein feed material deposited on said bed is separated into a heavier material transported on said bed in said first direction for discharge and collection, and lighter material transported by said bar sweeper in said second direction for discharge and collection.

2. The concentrator of claim 1 wherein said continuous loop conveyor includes a pair of large spaced drums over which said bed is transported, said substantially flat top segment being disposed between said drums, and, support means for supporting said substantially flat top segment.

3. The concentrator of claim 1 wherein said bar sweeper includes a chain link drive and sprocket apparatus with a sweeper bar support structure for continuous transport of said sweeper bars over said flat top segment of said bed proximate said riffles.

4. The concentrator of claim 3 wherein said sweeper bar support structure includes structural elements connecting said bar to said chain link drive, and cooperating guide structure engaging said chain link drive and structural elements for lineal support of interacting bars over said flat top segment of said bed.

5. The concentrator of claim 1 wherein said conveyer bed and sidewalls are constructed of a rubber-like material for impact resistance and water retention.

6. The concentrator of claim 2 wherein said spaced drums have enlarged disc-like end plates, and said conveyor sidewalls are constructed in a unitary ripple form for accordian expansion adjacent said end plates as the conveyor is transported over said drum.

7. The concentrator of claim 1 having means for adjusting the position or said sweeper bars relative to said riffles and said conveyer bed.

8. The concentrator of claim 7 wherein said adjustment means selectively positions said bar sweeper over said conveyer.

9. The concentrator of claim 7 wherein said adjustment means selectively positions said drums with respect to said bar sweeper.

10. The concentrator of claim 1 wherein said first drive means comprises a first drive mechanism connected to said conveyer for operating said conveyer at a select speed and said second drive means comprises a second independent drive mechanism connected to said sweeper for operating said sweeper at an independent select speed from the speed of said conveyer.

11. The concentrator of claim 1 in combination with an auxiliary material feed device and auxiliary ore discharge apparatus.

12. The concentrator of claim 1 including water spray means for cleaning said conveyor and said sweeper or supplementing the feed material.

13. The concentrator of claim 1 wherein said sweeper bar extends across the entirety of said bed and has a traingular cross section with a flat vertical leading face.

14. The concentrator of claim 1 including a support frame having adjustment means for variably orienting said frame relative to the ground.

15. The concentrator of claim 1 wherein said bar sweeper is a continuous loop device.

* * * * *